US012180627B2

(12) United States Patent
Ito et al.

(10) Patent No.: US 12,180,627 B2
(45) Date of Patent: Dec. 31, 2024

(54) METHOD FOR PRODUCING FIBER ARTICLES

(71) Applicant: DAICEL CORPORATION, Osaka (JP)

(72) Inventors: Yoshitaka Ito, Tokyo (JP); Masaya Omura, Tokyo (JP); Junko Makino, Tokyo (JP); Yuki Tsukamoto, Tokyo (JP); Fuai Uehara, Tokyo (JP); Hiroaki Shintani, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 300 days.

(21) Appl. No.: 17/637,741

(22) PCT Filed: Aug. 28, 2020

(86) PCT No.: PCT/JP2020/032652
§ 371 (c)(1),
(2) Date: Feb. 23, 2022

(87) PCT Pub. No.: WO2021/039979
PCT Pub. Date: Mar. 4, 2021

(65) Prior Publication Data

US 2022/0282413 A1 Sep. 8, 2022

(30) Foreign Application Priority Data

Aug. 30, 2019 (JP) ..... 2019-158820

(51) Int. Cl.
*D04H 1/4382* (2012.01)
*D04H 1/72* (2012.01)

(52) U.S. Cl.
CPC ..... *D04H 1/4382* (2013.01); *D04H 1/72* (2013.01)

(58) Field of Classification Search
CPC ..... D04H 1/4382; D04H 1/72; D04H 1/4318; D04H 1/43838; D04H 5/08; D02G 1/12; D02G 3/40
See application file for complete search history.

(56) References Cited

U.S. PATENT DOCUMENTS

2013/0031872 A1* 2/2013 Blaiss ..... D06B 21/00 53/111 R
2017/0265519 A1* 9/2017 Shibagaki ..... A24D 3/0204

FOREIGN PATENT DOCUMENTS

JP 6-116854 A 4/1994
JP 2012-188774 A 10/2012

OTHER PUBLICATIONS

Machine Translation of JP 2012-188774 A (Year: 2012).*
(Continued)

*Primary Examiner* — Brian Handville
(74) *Attorney, Agent, or Firm* — Birch, Stewart, Kolasch & Birch, LLP

(57) ABSTRACT

A production method for a fiber article includes: a contact step of, while transferring a plurality of first fibers, bringing a plurality of resin particles formed of high molecules that can be fiberized into contact with the plurality of first fibers; a first processing step of applying an external force to the plurality of first fibers brought into contact with the plurality of resin particles and narrowing gaps between fibers; and a second processing step of, by relieving the external force applied to the plurality of first fibers brought into contact with the plurality of resin particles, forming second fibers from the plurality of resin particles, the second fibers each having an outer diameter that is smaller than each of the first fibers and is set to a value in a range of 30 nm or more to 1.0 μm or less, and forming a fiber composite including the first fibers and the second fibers.

15 Claims, 7 Drawing Sheets

(56) References Cited

OTHER PUBLICATIONS

English translation of the International Preliminary Report on Patentability for International Application No. PCT/JP2020/032652, dated Sep. 3, 2021.

* cited by examiner

METHOD FOR PRODUCING FIBER ARTICLES

TECHNICAL FIELD

The present disclosure relates to a production method for a fiber article.

BACKGROUND ART

A fiber article is used, for example, as a filtration member that filters impurities from fluid, or as an absorbent member such as a sanitary product. Patent Document 1 discloses a nonwoven fabric that is a fiber article including different types of fibers. The present document discloses a production method for producing a nonwoven fabric by inserting a fiber stream of one type of fiber into the other fiber stream of another type of fiber while separately spinning and transferring the respective types of fibers.

CITATION LIST

Patent Document

Patent Document 1: JP H06-116854 A

SUMMARY OF INVENTION

Technical Problem

In a fiber article including different types of fibers, for example, fibers having different outer diameters are combined and the fiber article is configured to be bulky. Consequently, the function of each of type of fiber can be achieved and the performance of the fiber article can be improved. However, it may be difficult to efficiently produce such a fiber article that has high functionality. This problem is particularly prominent in a case where fibers having an extremely small outer diameters are used.

Therefore, an object of the present disclosure is to allow for, in the case of producing a fiber article by combining different types of fibers having different outer diameters, efficiently producing a bulky fiber article having high functionality.

Solution to Problem

In order to solve the problem described above, a production method for a fiber article includes: a contact step of, while transferring a plurality of first fibers, bringing a plurality of resin particles formed of high molecules that can be fiberized into contact with the plurality of first fibers; a first processing step of applying an external force to the plurality of first fibers brought into contact with the plurality of resin particles and narrowing gaps between fibers; and a second processing step of, by relieving the external force applied to the plurality of first fibers brought into contact with the plurality of resin particles, forming second fibers from the plurality of resin particles, the second fibers each having an outer diameter that is smaller than each of the first fibers and is set to a value in a range of 30 nm or greater to 1.0 μm or less, and forming a fiber composite including the first fibers and the second fibers.

According to the method described above, by performing the aforementioned steps, a bulky fiber article can be produced that includes the fine second fibers each having an outer diameter set to a value in the range of 30 nm or greater to 1.0 μm or less, and the first fibers each having an outer diameter larger than that of the second fiber. Further, the fine second fibers are combined with the first fibers, and the second fibers are supported by the first fibers. Therefore, compared to a case where a fiber article is produced only from resin fibers, for example, a bulky fiber article can be produced. In addition, a fiber article that can achieve the function of the second fibers over a long period of time can be produced. Furthermore, for example, the second fibers are formed of the plurality of resin particles dispersedly brought into contact with the first fibers, and thus the second fibers can be uniformly distributed and disposed within the fiber article and a fiber article having uniform quality can be produced.

In addition, by performing the steps described above, the fiber article can be efficiently and sequentially produced with the use of a single transfer facility. Therefore, a separate step of forming the second fibers can be omitted, and production steps are simplified and thus production costs can be reduced. As a result, a bulky fiber article having high functionality can be efficiently produced.

In the first processing step, a band may be formed by applying the external force to the first fibers to which the plurality of resin particles is added and crimping the first fibers. Consequently, the fiber article including the first fibers and the second fibers can be efficiently produced while using the band.

In the first processing step, while transferring the band, tensile force may be applied as the external force in a transfer direction to the plurality of first fibers brought into contact with the plurality of resin particles in the band. Additionally, in the first processing step, the plurality of first fibers may be inserted between a pair of nip rolls and pressed by the pair of nip rolls, whereby the external force is applied to the first fibers brought into contact with the plurality of resin particles. As a result, in the first processing step, the external force can be efficiently applied to the first fibers.

In the contact step, a dispersion in which the plurality of resin particles are dispersed may be used. By using the dispersion as just described, fluidity of the dispersion can be used to easily bring the plurality of resin particles into contact with a wide range of the surface of the first fibers.

The method may further include a drying step of, between the contact step and the first processing step, drying at least a portion of the dispersion applied to the first fibers. Therefore, by drying a portion of the dispersion before forming the band, the amount of the resin particles that drop from the first fibers can be reduced, and the weight ratio between the first fibers and the second fibers can be easily adjusted. Additionally, the resin particles are appropriately brought into contact with the first fibers, and thus formation of the second fibers in the second processing step can be facilitated.

An aqueous dispersion obtained by dispersing the plurality of resin particles in water may be used as the dispersion. As a result, the dispersion can be produced at relatively low cost and the dispersion can be easily handled.

In the contact step, the dispersion separated from the first fibers in the first processing step may be reused. Therefore, a reduction in the production costs can be further facilitated.

In the contact step, the plurality of resin particles in a powder form may be directly brought into contact with the first fibers. As a result, the plurality of resin particles can be brought into contact with the first fibers in a relatively simple manner.

In the first processing step, nip pressure set to a value of 0.05 MPa or greater may be applied as the external force to the plurality of first fibers brought into contact with the plurality of resin particles. By setting the nip pressure as just described, the second fibers can be appropriately and easily formed.

In the contact step, the plurality of resin particles including lamellar structures may be used. Therefore, in the second processing step, the second fibers can be easily formed from the plurality of resin particles.

In the second processing step, the fiber composite may be formed in which a weight ratio W1/W2 of a total weight W1 of the first fibers to a total weight W2 of the second fibers and the residual resin particles is set to a value in a range of 3.00 or greater to 200.00 or less. As a result, the second fibers can be stably supported on a support body formed of the first fibers, and thus the function of the second fibers can be easily achieved.

In the second processing step, a length dimension of the first fibers may form the fiber composite that is longer than a length dimension of the second fibers. As a result, for example, the first fibers are used as the framework of the fiber article and the second fibers are supported on the first fibers, and thus the function of the second fibers can be stably achieved.

In the contact step, the first fibers each having an outer diameter set to a value in a range of 5 μm or greater and 50 μm or less may be used. As a result, design flexibility of the fiber article can be improved.

In the contact step, the first fibers formed of at least one of rayon, polypropylene, polyethylene terephthalate, polyethylene, or cellulose acetate may be used. Additionally, in the contact step, the resin particles formed of at least one of polytetrafluoroethylene, polypropylene, polyethylene, or polyamide may be used.

According to the method described above, the fiber article including the first fibers and the second fibers can be efficiently produced, and the first fibers and the second fibers respectively formed of specific materials are combined, and thus the functions of the first fibers and the second fibers can be easily achieved.

Advantageous Effects of Invention

According to aspects of the present disclosure, in a case where a fiber article is produced by combining different types of fibers having different outer diameters, a bulky fiber article having high functionality can be efficiently produced.

DESCRIPTION OF EMBODIMENTS

Embodiments of the present invention will be described below with reference to the drawings.

First Embodiment

A production method for a fiber article according to a first embodiment includes: a contact step of, while transferring a plurality of first fibers, bringing a plurality of resin particles formed of high molecules that can be fiberized into contact with the plurality of first fibers; a first processing step of applying an external force to the plurality of first fibers brought into contact with the plurality of resin particles and narrowing gaps between fibers; and a second processing step of, by relieving the external force applied to the plurality of first fibers brought into contact with the plurality of resin particles, forming second fibers from the plurality of resin particles, the second fibers each having an outer diameter that is smaller than each of the first fibers and is set to a value in a range of 30 nm or greater to 1.0 μm or less, and forming a fiber composite including the first fibers and the second fibers. In order to perform the first processing step, in the present embodiment, the plurality of first fibers are crimped, and thus external force is applied to the plurality of first fibers. A band production apparatus and a fiber article production apparatus that are used in the production method will be described below.

Band Production Apparatus

Figure 1:
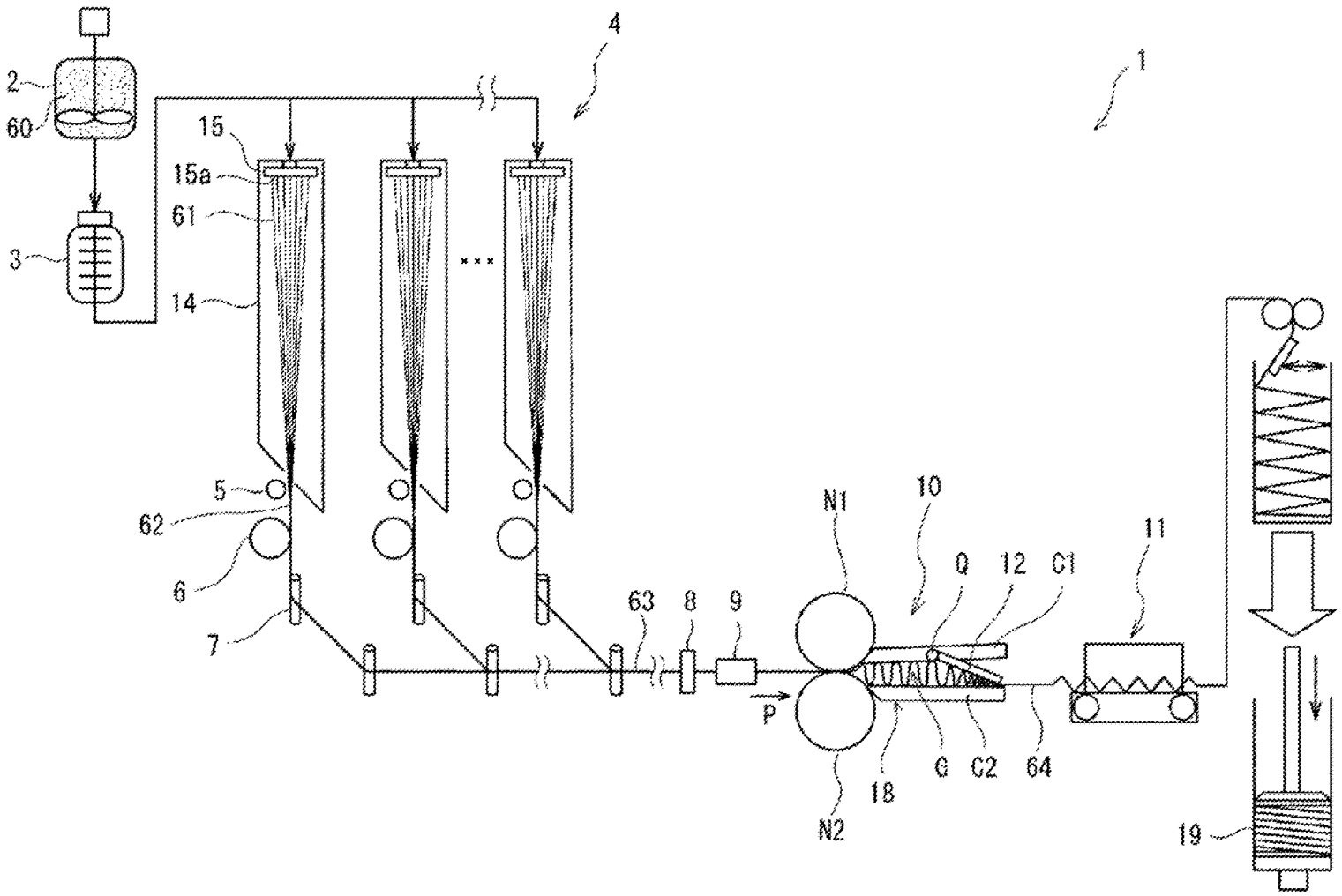
FIG. 1 is a schematic diagram of a band production apparatus according to a first embodiment.

FIG. 1 is an overall view of a band production apparatus 1 according to the first embodiment. The band production apparatus 1 illustrated in FIG. 1 spins filaments 61 as first fibers by dry spinning. Further, the band production apparatus 1 produces a yarn 62, an end 63, and a band 64 from a plurality of the filaments 61. The raw material of the filament 61 may be any material from which the yarn 62, the end 63, and the band 64 are appropriately obtained, for example, in the spinning method to be selected. The filament 61 of the present embodiment includes at least one of rayon, polypropylene, polyethylene terephthalate, polyethylene, or cellulose acetate. As an example, the filament 61 is made of cellulose acetate.

The band production apparatus 1 is provided with a mixing apparatus 2, a filtration apparatus 3, a spinning unit 4, lubrication units 5, godet rolls 6, guide pins 7, an application apparatus 8, a first drying apparatus 9, a crimping apparatus 10, and a second drying apparatus 11.

In the band production apparatus 1, a predetermined spinning dope 60 is used. As an example, the spinning dope 60 is formed by dissolving flakes made of, for example, cellulose diacetate in an organic solvent at a predetermined concentration. During driving of the band production apparatus 1, the spinning dope 60 is mixed by the mixing apparatus 2 and then filtered by the filtration apparatus 3. The spinning dope 60 passed through the filtration apparatus 3 is extruded from a plurality of orifices 15*a* of a spinneret 15 provided on a cabinet 14 of the spinning unit 4.

The orifice 15*a* has a circumference shape formed into a predetermined shape (for example, a circular shape). The diameter of each orifice 15*a* is set as appropriate in accordance with a denier per filament (FD) of the produced filaments 61. The spinning dope 60 extruded from each orifice 15*a* is heated by hot air supplied from a drying unit (not illustrated) into the cabinet 14 and the organic solvent evaporates, and thus the spinning dope 60 is dried. As a result, the solid filaments 61 are formed.

As illustrated in FIG. 1, the plurality of filaments 61 passed through the single cabinet 14 are gathered by the guide pins 7, thereby forming the yarn 62. After the lubricant is applied by the lubrication unit 5, the yarn 62 is wound by the godet roll 6. The yarn 62 is then taken up by a predetermined winding device.

The series of units for producing the yarn 62, i.e., the spinning unit 4 that extrudes the spinning dope 60 from the spinneret 15 and spins the filaments 61, the drying unit, the lubrication unit 5, and the winding unit that includes the godet rolls 6, is collectively referred to as a station. Typically, a plurality of stations are arranged in a line.

A plurality of yarns 62 passed through each station is transferred along the arrangement direction of the stations and sequentially accumulated or layered. With this configuration, the plurality of yarns 62 are layered to form the end (a tow) 63, which is a flat assembly of the yarns 62. The end 63 is formed by layering the plurality of yarns 62 and setting the yarns to a predetermined total denier (TD). The end 63 is transferred and guided to the application apparatus 8.

Note that the method for spinning the filaments 61 is not limited, and may be a method other than the dry spinning method (for example, a melt spinning method or a wet spinning method). The method for spinning the filaments 61 may be any method provided that the band 64 is appropriately obtained.

The application apparatus 8 applies a dispersion including resin particles 66 to the filaments 61 while transferring a plurality of first fibers (here, the end 63). For example, the application apparatus 8 includes a reservoir that stores the dispersion, and an affixing roll that is pivotally supported such that the dispersion in the reservoir is applied to the roll surface to be applied to the filaments 61. The dispersion of the present embodiment is an aqueous dispersion obtained by dispersing the plurality of resin particles 66 in water. The dispersion may include a liquid other than water.

The resin particle 66 internally includes a lamellar structure. The lamellar structure herein corresponds to a structure in which polymer chains constituting a resin of the resin particles 66 are linked and folded. The lamellar structure internally included in the resin particles 66 comprises fine fibers, specifically, in which millions of the polymer chains are linked and formed into a ribbon shape. The fine fibers are folded and stored in the resin particles 66.

The resin particles 66 are primary particles, and the plurality of resin particles 66 bond to each other to form secondary particles. When an external force is applied to the secondary particles (in other words, two bonded resin particles 66) such that the resin particles 66 are separated, the fine fibers are drawn out of the resin particles 66, and resin fibers 66*a* are formed from the resin particles 66. In the dispersion of the present embodiment, the primary particles formed of the plurality of resin particles 66 are contained in a dispersed manner in the solvent. The application apparatus 8 applies the dispersion to the filaments 61, and thus the plurality of resin particles 66 are dispersedly brought into contact with the surface of the filaments 61. The external force is applied to the plurality of filaments 61 to narrow gaps between fibers, and thus the plurality of resin particles 66 brought into contact with the surface of the different filaments 61 adhere to each other. In addition, the external force applied to the plurality of filaments 61 is relieved, and thus the adhered resin particles 66 are separated and the resin fibers 66*a* are formed.

The resin particles 66 of the present embodiment may be formed, for example, by a polymerization reaction and may contain lamellar structures. The resin particles 66 are made of, for example, at least one of PTFE (polytetrafluoroethylene), polypropylene, polyethylene, or polyamide. The resin particles 66 are made of PTFE as an example.

Here, the resin particles 66 are set to have a mean particle size of a value in a range of 100 nm or greater to 100 μm or less (for example, approximately 300 nm). As an example, the value of the mean particle size is further preferably in a range of 200 nm or greater to 700 nm or less, and is still further preferably in a range of 250 nm or greater to 400 nm or less. Note that the mean particle size refers to the median diameter (cumulative 50% diameter (D50)) calculated from measurement results of dynamic light scattering. The resin particles 66 are formed, for example, by paste extrusion.

The first drying apparatus 9 dries at least a portion of the dispersion applied to the filaments 61. The crimping apparatus 10 crimps the filaments 61. As an example, the crimping apparatus 10 includes a pair of nip rolls N1, N2 and a stuffing box 18. Rotating shafts of the pair of nip rolls N1, N2 are arranged in parallel to each other. The pair of nip rolls N1, N2 press the end 63 between the roll surfaces of the respective rolls.

The stuffing box 18 is disposed on a rear side of the pair of nip rolls N1, N2 in a transfer direction P. The stuffing box 18 includes a pair of plate members C1, C2 each having a plate surface extending in the transfer direction P, and a biasing member 12. The pair of plate members C1, C2 are disposed with the plate surfaces facing each other across a gap G and with the gap G decreasing from a front side to a rear side of the stuffing box 18 in the transfer direction P. The end 63 (the plurality of filaments 61) passed through the pair of nip rolls N1, N2 is transferred in the gap G.

The biasing member 12 is a plate member as an example, and extends in a direction perpendicular to the transfer direction P along the plate surface of the plate member C1. A front end of the biasing member 12 in the transfer direction P is supported by the plate member C1 to be rotatable about an axis Q extending in the direction perpendicular to the transfer direction P along the plate surface of the plate member C1. The biasing member 12 is biased toward the plate surface of the plate member C2 and presses the end 63 transferred between the pair of plate members C1, C2.

The end 63 is pressed between the pair of nip rolls N1, N2 by the pair of nip rolls N1, N2 and is thereafter pushed into the stuffing box 18. The end 63 is pressed against the plate surface of the plate member C2 by the biasing member 12 while being transferred in a meandering manner between the plate surfaces of the plate members C1, C2. The end 63 is pushed into the stuffing box 18 by the pair of nip rolls N1, N2 by a force larger than a force applied to the end 63 from the plate members C1, C2 and the biasing member 12, and thus crimping is applied to the end 63. The end 63 passes through the crimping apparatus 10, thereby forming the band 64. Further, the plurality of filaments 61 in the end 63 are pressurized in the crimping apparatus 10. As a result, the gaps between fibers are narrowed and the plurality of resin particles 66 that have been brought into contact with the filaments 61 bond together. As a result, the secondary particles of the resin particles 66 are formed.

In the crimping apparatus 10, nip pressure of the pair of nip rolls N1, N2 is desirably set to a value in a suitable pressure range in order to appropriately crimp the filaments 61 and reduce the amount of dropping of the dispersion from the filaments 61. The band 64 passed through the crimping apparatus 10 is further dried by the second drying apparatus 11.

Figure 2:
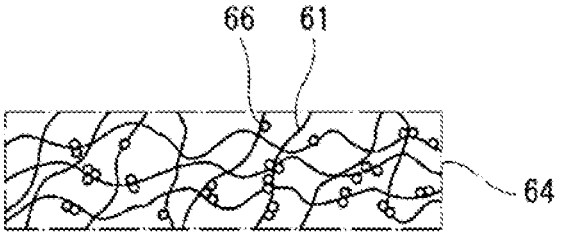
FIG. 2 is a schematic cross-sectional view of a band produced by the band production apparatus of FIG. 1.

FIG. 2 is a schematic cross-sectional view of the band 64 produced by the band production apparatus 1 of FIG. 1. As illustrated in FIG. 2, the band 64 includes the plurality of crimped filaments 61 and the plurality of resin particles 66 dispersed into the band 64 and supported on the filaments 61. The surface of the filaments 61 is partially covered by the plurality of resin particles 66. The plurality of resin particles 66 are supported on the filaments 61 while being bonded together. By using the crimped filaments 61, the band 64 is formed to be bulky.

The TD and FD of the band 64 may be set as appropriate. The FD of the band 64 is set to a value in a range of, for example, 1.0 or greater to 10.0 or less. From the perspective of appropriately securing the gaps between fibers while retaining appropriate strength of the filaments 61, it is desirable that the FD of the band 64 is further set to a value in a range of 2.0 or greater to 6.0 or less. As illustrated in FIG. 1, the band 64 passed through the second drying apparatus 11 is accumulated and then pressurized and packaged in a packaging container 19, thereby forming a bale shape. FIG. 1 illustrates a cross-sectional structure of the packaging container 19.

PTFE Used as Material of Resin Particles 66

Next, the PTFE used as the material of the resin particles 66 will be described. The PTFE is configured as high molecules that can be fiberized. Such PTFE is high molecular weight PTFE obtained from, for example, emulsion polymerization or suspension polymerization of TFE (tetrafluoroethylene). The high molecular weight PTFE may be at least any of modified PTFE or homo PTFE.

The modified PTFE consists of TFE and a monomer (modified monomer) other than TFE. Typically, the modified PTFE is uniformly denatured by the modified monomer or is denatured at the early or end stage of a polymerization reaction, but the modified PTFE is not particularly limited. The modified PTFE includes a TFE unit based on TFE and a modified monomer unit based on a modified monomer.

In addition, the modified monomer unit is a part of a molecular structure of the modified PTFE, and is a part derived from the modified monomer. The total monomer unit is derived from all monomers in the molecular structure of the modified PTFE. As long as the modified monomer can be copolymerized with TFE, the modified monomer is not particularly limited.

Herein, "high molecular weight" of the high molecular weight PTFE refers to a molecular weight at which the PTFE is easily fiberized at the time of producing the band 64 and at which fibrils having a long fiber length are obtained. The high molecular weight is a value of a standard specific gravity (SSG) in a rage of 2.130 or greater and 2.230 or less, and indicates a molecular weight at which melt flow substantially does not occur due to high viscosity. Note that, for information regarding PTFE that can be fiberized, for example, WO 2013/157647 can be referred to.

Fiber Article Production Apparatus

Figure 3:
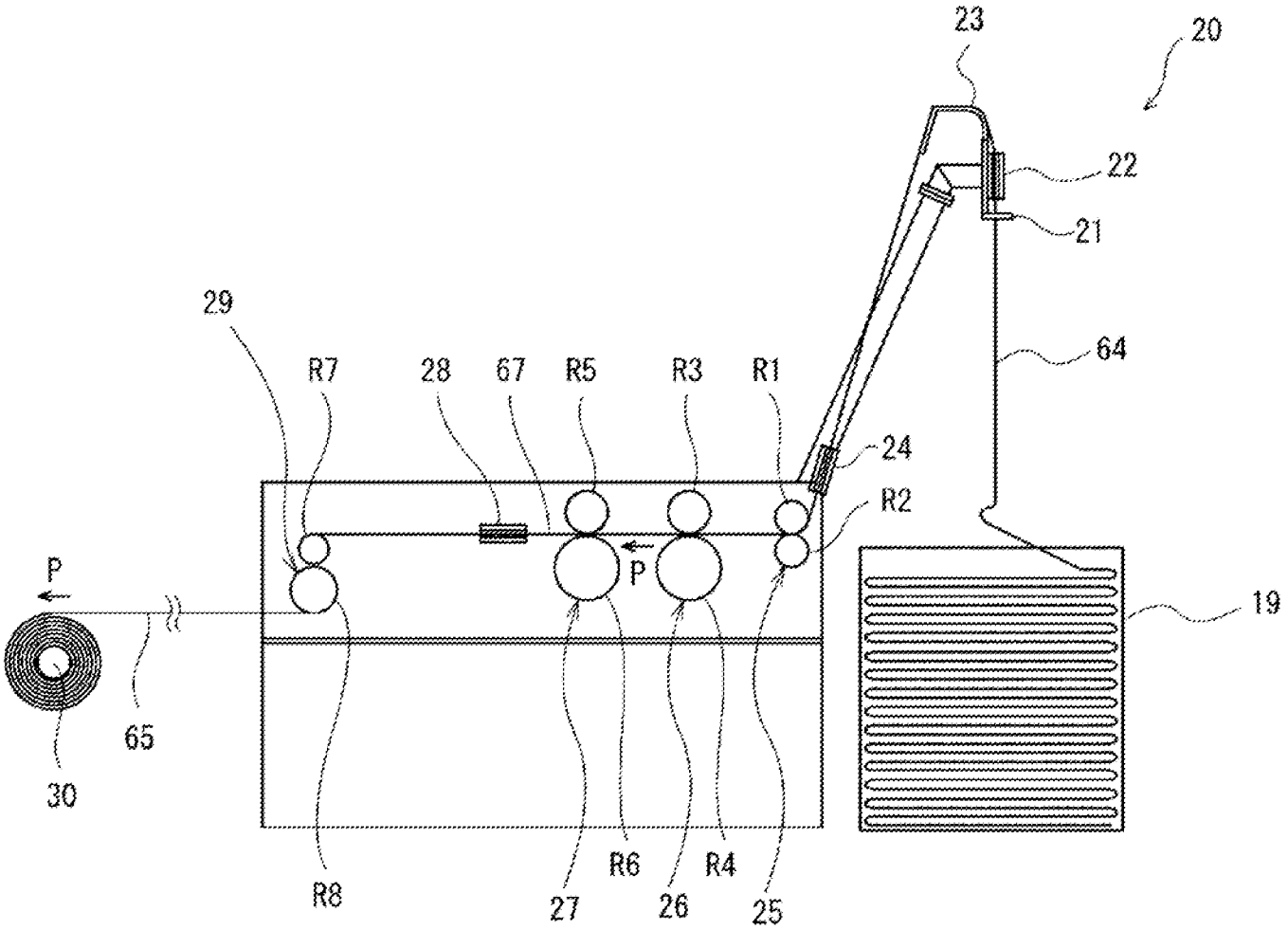
FIG. 3 is a schematic diagram of a fiber article production apparatus according to the first embodiment.

FIG. 3 is an overall view of a fiber article production apparatus 20 according to the first embodiment. FIG. 3 illustrates a cross-sectional structure of the packaging container 19. As illustrated in FIG. 3, the fiber article production apparatus 20 includes a layering ring 21, a first filament opening unit 22, a turn baffle 23, a second filament opening unit 24, a pair of pre-tension rolls 25, a pair of first filament opening rolls 26, a pair of second filament opening rolls 27, a third filament opening unit 28, a pair of transfer rolls 29, and a winding roll 30.

The layering ring 21 and the turn baffle 23 guide the bale-shaped band 64 fed up from within the packaging container 19 toward the first filament opening unit 22. The first filament opening unit 22, the second filament opening unit 24, and the third filament opening unit 28 open the band 64 in the width direction of the band 64 by using gas (for example, pressurized air). The pair of pre-tension rolls 25, the pair of first filament opening rolls 26, and the pair of second filament opening rolls 27 open the band 64 in the width direction and the transfer direction P in a state where the band 64 is subject to tensile force in the transfer direction P.

The pair of pre-tension rolls 25 include a pair of rolls R1, R2 arranged with the roll surfaces facing each other. The pair of first filament opening rolls 26 include a pair of rolls R3, R4 arranged with the roll surfaces facing each other. The pair of second filament opening rolls 27 include a pair of rolls R5, R6 arranged with the roll surfaces facing each other. Grooves extending in a circumferential direction are formed on the roll surfaces of the rolls R3 to R6 and are configured to easily open the band 64.

The pair of transfer rolls 29 include a pair of rolls R7, R8 arranged with the roll surfaces facing each other. The pair of transfer rolls 29 transfer the band 64 passed through the pair of second filament opening rolls 27 to the winding roll 30 side. The winding roll 30 winds the band 64 passed through the pair of transfer rolls 29.

During driving of the fiber article production apparatus 20, the band 64 fed up from within the packaging container 19 is inserted through the layering ring 21 and is thereafter opened in the width direction by the first filament opening unit 22. Afterward, the band 64 is guided by the turn baffle 23 toward the second filament opening unit 24.

Next, the band 64 is further opened in the width direction by the second filament opening unit 24 and is thereafter sequentially inserted between the rolls R1, R2, between the rolls R3, R4, and between the rolls R5, R6. The band 64 makes contact with the rolls R1 to R6. The rotating speed of the pair of rolls R5, R6 is higher than the rotating speed of the pair of rolls R3, R4. Therefore, the band 64 is opened in the transfer direction P and the width direction while being subject to tensile force in the transfer direction P by the pair of first filament opening rolls 26 and the pair of second filament opening rolls 27.

Figure 4:
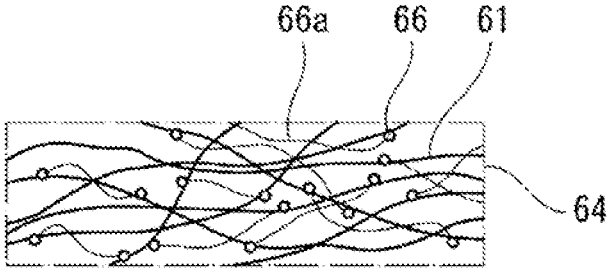
FIG. 4 is a schematic cross-sectional view of a band that is transferred between a pair of first filament opening rolls and a pair of second filament opening rolls illustrated in FIG. 3.

Here, FIG. 4 is a schematic cross-sectional view of the band 64 transferred between the pair of first filament opening rolls 26 and the pair of second filament opening rolls 27 of FIG. 3. As illustrated in FIG. 4, the band 64 is opened in the transfer direction P (the left-right direction on the plane of paper) and the width direction (the direction perpendicular to the plane of paper) by the pair of rolls 26, 27, and thus the tensile force acts on the filaments 61 and the resin particles 66 in the transfer direction P and the width direction. As a result, the plurality of filaments 61 in the band 64 are opened.

At this time, the tensile force (stretching force) acts on the resin particles 66 to separate the resin particles 66 bonded to each other, and thus the fine fibers folded in the resin particles 66 are efficiently elongated and the resin fibers **66*a* are formed. Therefore, the band 64 is formed into a fiber composite 67 including the filaments 61 and the resin fibers 66*a***.

As just described, in the present embodiment, the resin fibers **66*a* can be formed by opening the plurality of filaments 61 in the band 64 and using the tensile force applied to the band 64 during opening. Therefore, a dedicated process or equipment for separately forming the resin fibers 66*a*** is not required.

Here, the resin fibers 66*a* are formed at the time of opening the band 64; however, the resin fibers 66*a* are formed by applying an external force to narrow the gaps between fibers with respect to the plurality of filaments 61 to which the plurality of resin particles 66 are brought into contact, and then relieving the external force. In the present embodiment, the dispersion is applied to the plurality of filaments 61 by the application apparatus 8 and then the external force is applied at least once. Thereafter, the external force is relieved, and the resin fibers 66*a* are formed. Thus, the resin fibers 66*a* can be also formed, for example, by applying nip pressure as the external force to the plurality of filaments 61 brought into contact with the plurality of resin particles 66, by at least any of the pair of nip rolls N1, N2, the pair of first filament opening rolls 26, and the pair of second filament opening rolls 27. In order to form the resin fibers 66*a*, for example, at least one of the external forces described above may be used.

The outer diameter of the resin fiber 66*a* can be adjusted by, for example, the tensile force applied to the band 64 at the time of opening the band 64. For example, when the tensile force is increased, the outer diameter of the resin fiber 66*a* can be set to be small and the length dimension of the resin fiber 66*a* can be set to be long. When the tensile force is decreased, the outer diameter of the resin fiber 66*a* can be set to be large and the length dimension of the resin fiber 66*a* can be set to be short.

With such an adjustment, in the present embodiment, the outer diameter of the resin fiber 66*a* can be set to a value in a range of 30 nm or greater to 1.0 μm or less. As illustrated in FIG. 3, the fiber composite 67 passed between the pair of second filament opening rolls 27 is inserted between the rolls R7, R8 of the pair of transfer rolls 29. The rotating speed of the pair of rolls R7, R8 is slower than the rotating speed of the pair of rolls R5, R6. Therefore, the tensile force applied to the fiber composite 67 in the transfer direction P between the pair of first filament opening rolls 26 and the pair of second filament opening rolls 27 is relieved between the pair of second filament opening rolls 27 and the pair of transfer rolls 29. Relieving this tensile force adjusts the fiber composite 67 to be bulky.

Figure 5:
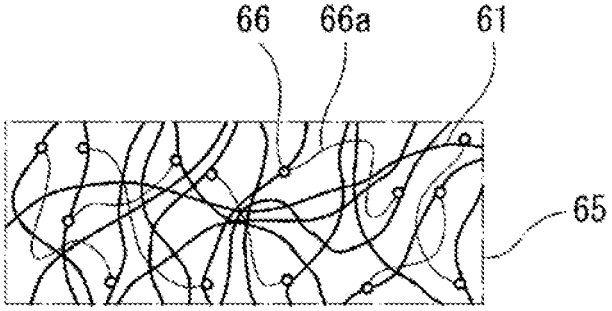
FIG. 5 is a cross-sectional view of a fiber article produced by the fiber article production apparatus of FIG. 3.

The fiber composite 67 passed through the pair of transfer rolls 29 is wound on the winding roll 30. The fiber composite 67 is cut to a predetermined length dimension, and thus a fiber article 65 is produced. FIG. 5 is a cross-sectional view of the fiber article 65 produced by the fiber article production apparatus 20 of FIG. 3.

As illustrated in FIG. 5, within the fiber article 65, the resin fibers 66*a* are supported on the filaments 61 while being intertwined with the filaments 61. Accordingly, even when the resin fiber 66*a* is thinner than the filament 61, the resin fibers 66*a* can be supported on the filaments 61 while the resin fibers 66*a* are prevented from being cut. Therefore, the function of the resin fibers 66*a* can be maintained over a long period of time. The resin fibers 66*a* are dispersedly disposed throughout the inside of the band 64. Note that a portion of the resin particles 66 may be decreased in size or may be exhausted within the fiber article 65 in accordance with forming of the resin fibers 66*a*.

The fiber article 65 is formed bulkier by the plurality of filaments 61 that are opened with abundant gaps between fibers therein. Therefore, the fiber article 65 has an appropriate airy texture. The fiber article 65 is formed into a sheet-like article as an example. Note that the fiber article 65 may be formed by overlaying and crimping a plurality of sheet-like fiber composites 67. In this case, for example, the thickness dimension of the fiber article 65 can be easily designed by adjusting the number of fiber composites 67. Additionally, the fiber article 65 may be formed with the plurality of sheet-like fiber composites 67 arranged side by side in the width direction. In this case, for example, the width dimension of the fiber article 65 can be easily designed by adjusting the number of the fiber composites 67.

The value of the external force applied to the plurality of filaments 61 to form the resin fibers 66*a* can be set as appropriate, but may be a value of, for example, 0.05 MPa or greater. When the fiber article 65 is used in filtration, the value of the external force applied to the plurality of filaments 61 is desirably a value of, for example, 0.10 MPa or greater in order to obtain good filter performance. Note that the upper limit of the external force may be a value of, for example, 1 MPa or greater (e.g., several tens of MPa or greater).

As described above, the fiber article 65 is produced by a production method using the band production apparatus 1 and the fiber article production apparatus 20. The production method includes a contact step, a first processing step, and a second processing step. The production method of the present embodiment further includes a drying step.

The contact step is a step of bringing the plurality of resin particles 66 formed of high molecules that can be fiberized (in the present embodiment, the dispersion that includes the plurality of resin particles 66 containing lamellar structures and connected to each other) into contact with the filaments 61 while transferring the plurality of filaments 61. The first processing step is a step of applying an external force to the plurality of filaments 61 brought into contact with the plurality of resin particles 66, and narrowing the gaps between fibers.

Further, in the first processing step of the present embodiment, the external force is applied to the filaments 61 to which the plurality of resin particles 66 are added and the filaments 61 are crimped, and thus the band 64 is formed. Furthermore, for example, in the first processing step, while transferring the band 64, tensile force is applied as the external force in the transfer direction P to the plurality of filaments 61 in the band 64 brought into contact with the plurality of resin particles 66.

Additionally, in the first processing step of the present embodiment, for example, nip pressure set to a value of 0.05 MPa or greater is further applied as the external force to the plurality of filaments 61 brought into contact with the plurality of resin particles 66. The nip pressure is applied, for example, by at least any (here, by all) of the pair of nip rolls N1, N2, the pair of first filament opening rolls 26, and the pair of second filament opening rolls 27. As a result, the resin fibers 66*a* are abundantly formed.

The second processing step is a step of forming the resin fibers 66*a* from the plurality of resin particles 66 by relieving the external force applied to the plurality of filaments 61 brought into contact with the resin particles 66, and forming the fiber composite 67 including the filaments 61 and the resin fibers 66*a*.

The drying step is a step of, between the contact step and the first processing step, drying at least a portion of the dispersion applied to the filaments 61. In the present embodiment, for example, the dispersion separated from the filaments 61 in the first processing step is recovered, and the recovered dispersion is used in the contact step.

In addition, in the fiber composite 67, a weight ratio W1/W2 of a total weight W1 of the filaments 61 and a total weight W2 of the resin fibers 66*a* and the residual resin particles 66 can be set as appropriate. In the second processing step of the present embodiment, the fiber composite 67 in which, for example, the weight ratio W1/W2 is set to a value in a range of 3.00 or greater to 200.00 or less is formed. As a result, in the fiber article 65, the resin fibers 66*a* can be stably supported on a support body formed of the filaments 61, and thus the function of the resin fibers 66*a* can be easily achieved. As another preferable example, the weight ratio W1/W2 may include a value in a range of 9.00 or greater to 200 or less. In a case where the resin particles 66 are formed of PTFE, a value in the range of the weight ratio W1/W2 corresponds to a value in a range of 0.5% or greater to 10% or less of the application concentration of PTFE in the fiber composite 67. Additionally, in the contact step, the filaments 61 each having an outer diameter set to a value in a range of 5 μm or greater to 50 μm is used. As a result, design flexibility of the fiber article can be improved.

Note that by setting the weight ratio W1/W2 to a value in the range described above, a volume ratio V1/V2 of a total volume V1 of the filaments 61 (first fibers) to a total volume V2 of the resin fibers 66*a* (second fibers) and the residual resin particles 66 has a maximum value of 124.0 or less. As a result, the function of the resin fibers 66*a* can be easily achieved while the gaps between fibers inside of the fiber article 65 are appropriately maintained and the resin fibers 66*a* are stably held by the filaments 61.

Moreover, the length dimension of the filaments 61 and the length dimension of the resin fibers 66*a* can be set as appropriate. In the second processing step of the present embodiment, the length dimension of the filaments 61 forms the fiber composite 67 that is longer than the length dimension of the resin fibers 66*a*. As a result, for example, the filaments 61 are used as the framework of the fiber article 65 and the resin fibers 66*a* are supported on the filaments 61, and thus the function of the resin fibers 66*a* can be stably achieved.

As described above, according to the production method of the present embodiment, by performing the aforementioned steps, the bulky fiber article 65 can be produced that includes the fine resin fibers 66*a* each having an outer diameter set to a value in the range of 30 nm or greater to 1.0 μm or less, and the filaments 61 each having an outer diameter larger than that of the resin fiber 66*a*. Further, the fine resin fibers 66*a* are combined with the filaments 61, and the resin fibers 66*a* are supported by the filaments 61. Therefore, compared to a case where a fiber article is produced only from resin fibers, for example, the bulky fiber article 65 can be produced and the function of the resin fibers 66*a* in the fiber article 65 can be achieved over a long time. Furthermore, for example, the resin fibers 66*a* are formed of the plurality of resin particles 66 dispersedly brought into contact with the filaments 61, and thus the resin fibers 66*a* can be uniformly distributed and disposed within the fiber article 65 and the fiber article 65 having uniform quality can be produced.

In addition, by performing the steps described above, the fiber article 65 can be efficiently and sequentially produced with the use of a single transfer facility. Therefore, a separate step of forming the resin fibers 66*a* can be omitted, and production steps are simplified and thus production costs can be reduced. As a result, the bulky fiber article 65 having high functionality can be efficiently produced.

In the related art, to produce a bulky fiber article, for example, needle-punching a fiber sheet made of short fibers and laminating a plurality of the fiber sheets to form a laminate are required. In the present embodiment, these processes are not required. Further, according to the present embodiment, the fiber article 65 having both a good bulkiness and a void ratio, which has been difficult to achieve in the prior art, can be produced relatively simply and efficiently. Furthermore, according to the present embodiment, the bulky fiber article 65 including fine fibers each having an outer diameter of 1.0 μm or less, which has been difficult to stably mass-produce in the prior art, can be appropriately produced.

Further, in the first processing step of the present embodiment, the external force is applied to the filaments 61 to which the plurality of resin particles 66 are added, thereby crimping the filaments 61. Therefore, the band 64 is formed. Consequently, the fiber article 65 including the filaments 61 and the resin fibers 66*a* can be efficiently produced while using the band 64.

Also, as an example, in the first processing step, tensile force is applied as the external force in the transfer direction to the band 64 while transferring the band 64. Therefore, in the first processing step, the external force can be efficiently applied to the filaments 61.

Furthermore, in the contact step of the present embodiment, the dispersion in which the plurality of resin particles 66 are dispersed is used. By using the dispersion as just described, fluidity of the dispersion can be utilized to easily bring the plurality of resin particles 66 into contact with a wide range of the surface of the filaments 61.

In addition, since the production method includes the drying step, by drying a portion of the dispersion before forming the band 64, the amount of the resin particles 66 that drop from the filaments 61 can be reduced, and the weight ratio between the filaments 61 and the resin fibers 66*a* can be easily adjusted. Further, the resin particles 66 are appropriately brought into contact with the filaments 61, and thus the formation of the resin fibers 66*a* in the second processing step can be facilitated.

Furthermore, since an aqueous dispersion obtained by dispersing the plurality of resin particles 66 in water is used as the dispersion, the dispersion can be produced at relatively low cost and the dispersion can be easily handled. Further, the dispersion separated from the filaments 61 in the first processing step is reused in the contact step, and therefore a reduction in the production costs can be further facilitated.

Furthermore, in the first processing step, as an example, nip pressure set to a value of 0.05 MPa or greater is applied as the external force to the plurality of filaments 61 brought into contact with the plurality of resin particles 66. By setting the nip pressure as just described, the resin fibers 66*a* can be appropriately and easily formed.

Additionally, in the contact step, the plurality of resin particles 66 including lamellar structures are used. Therefore, in the second processing step, the resin fibers 66*a* can be easily formed from the plurality of resin particles 66.

In the contact step, the filaments 61 formed of at least one of rayon, polypropylene, polyethylene terephthalate, polyethylene, or cellulose acetate may be used. Also, in the contact step, the resin particles 66 formed of at least one of polytetrafluoroethylene, polypropylene, polyethylene, or polyamide may be used.

According to the method described above, the fiber article 65 including the filaments 61 and the resin fibers 66*a* can be efficiently produced, and the filaments 61 and the resin fibers 66*a* respectively formed of specific materials are combined, and thus the functions of the filaments 61 and the resin fibers 66*a* can be easily achieved.

Note that in the first processing step, the external force applied to the plurality of filaments 61 may be a force applied to the plurality of filaments 61 at a timing other than the timing of crimping the filaments 61 or opening the band including the crimped filaments 61.

Modification

Figure 6:
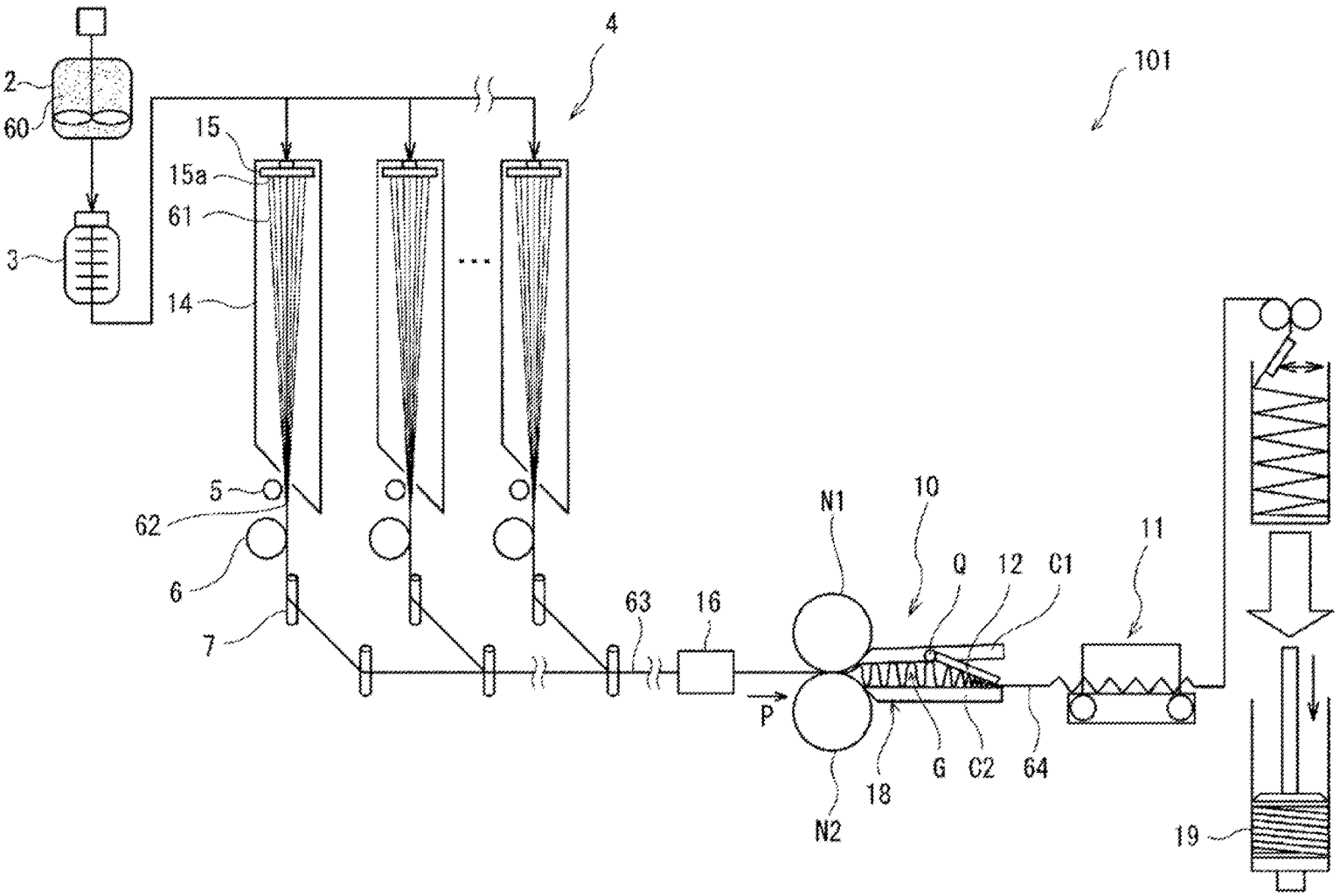
FIG. 6 is a schematic diagram of a band production apparatus according to a modified example of the first embodiment.

FIG. 6 is a schematic diagram of a band production apparatus 101 according to a modified example of the first embodiment. As illustrated in FIG. 6, in the band production apparatus 101, the application apparatus 8 and the first drying apparatus 9 are omitted, and in place of these, the band production apparatus 101 includes a particle adding apparatus (feeder) 16. The particle adding apparatus 16 is disposed at the cabinet 14 side rather than at the crimping apparatus 10 (here, between the godet rolls 6 and the crimping apparatus 10 in the transfer direction P) such that the resin particles 66 in a powder form can be added to the filaments 61.

By using such a band production apparatus 101, the plurality of resin particles 66 in a powder form are directly applied to the filaments 61 in the contact step of the present modified example. Here, water or a fiber oil agent is usually applied to the filaments 61 to be introduced into the crimping apparatus 10. Therefore, the resin particles 66 appropriately adhere to the surface of the filaments 61. According to this method, the plurality of resin particles 66 can be brought into contact with the filaments 61 in a relatively simple manner. Hereinafter, a second embodiment will be described focusing on differences from the first embodiment.

Second Embodiment

Figure 7:
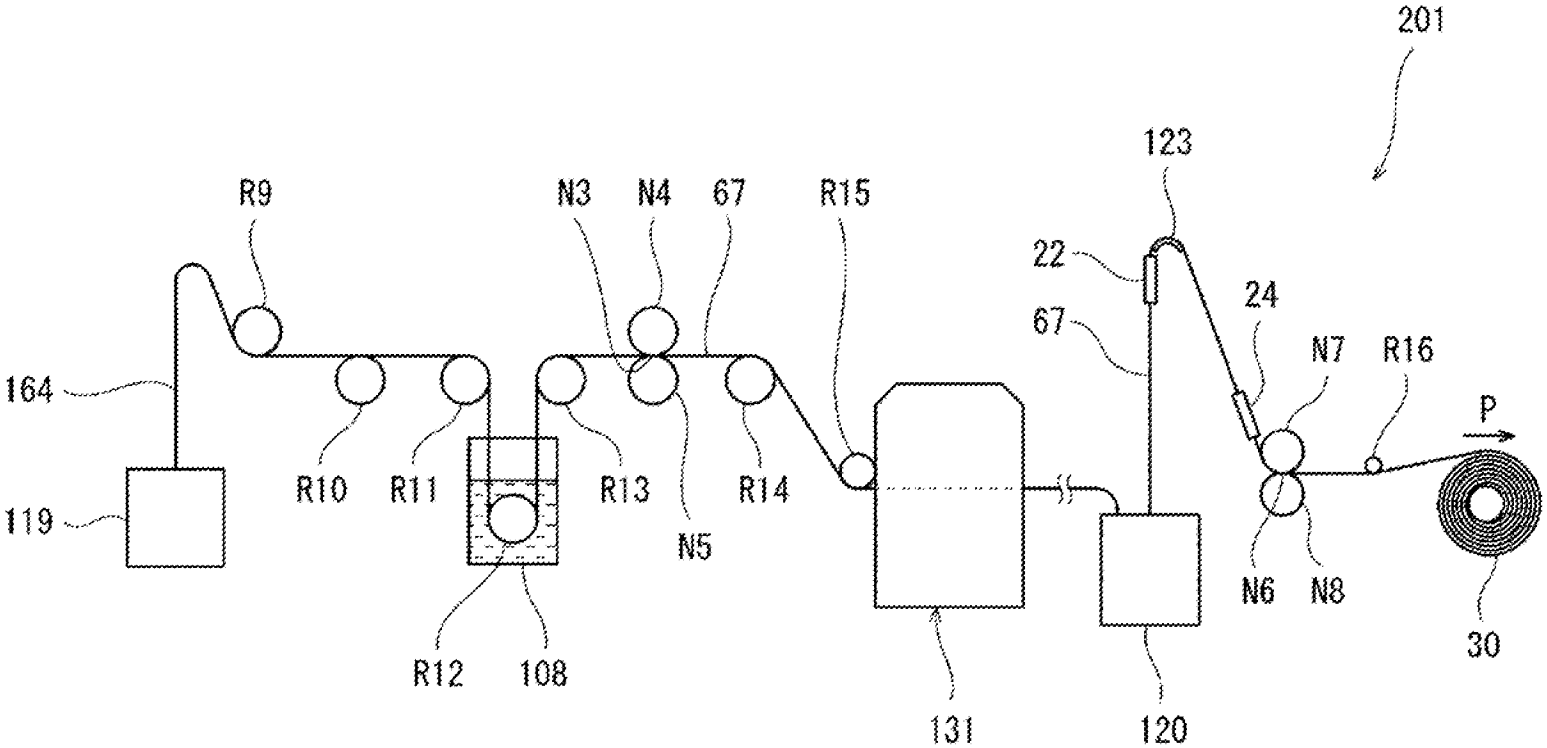
FIG. 7 is a schematic diagram of a band production apparatus according to a second embodiment.

FIG. 7 is a schematic view of a fiber article production apparatus 201 according to a second embodiment. In the present embodiment, a bale-like band 164 that does not include the resin particles 66 and is not crimped is used. The band 164 is compressed and packaged in a packaging container 119.

As illustrated in FIG. 7, the fiber article production apparatus 201 includes a plurality of guide members (for example, guide rolls R9 to R16) dispersedly disposed to guide the band 164 fed from the packaging container 119 in the transfer direction P, an application apparatus 108 that applies a dispersion to the band 164 being transferred, a pair of nip rolls N4, N5 that causes the tow band 164 to which the dispersion is applied to pass through a nip point N3, and a drying apparatus 131 that dries the band 164 (fiber composite 67) passed through the nip rolls N4, N5. Within the application apparatus 108, the band 164 is guided by the guide roll R12 and immersed in the dispersion based on a dip coating method, thereby being applied with the dispersion. The band 164 to which the dispersion is applied by the application apparatus 108 and which is dried by the drying apparatus 13 is temporarily packaged in another packaging container 120.

The fiber article production apparatus 201 also includes the first filament opening unit 22 that widens the band 164 fed from the packaging container 120, a turn baffle 123 that guides the band 164, the second filament opening unit 24 that widens the band 164 passed through the turn baffle 123, and a pair of nip rolls N7, N8 that causes the band 164 passed through the second filament opening unit 24 to pass through a nip point N6.

According to the fiber article production apparatus 201, the band 164 to which the plurality of resin particles 66 are brought into contact passes through the nip point N3 of the nip rolls N4, N5, and an external force (nip pressure) is applied to the plurality of filaments 61 to narrow the gaps between fibers. Also, thereafter, the external force applied to the filaments 61 is relieved. At this time, in the gaps between fibers, a large number of the resin particles 66 are dispersed and brought into contact with the surface of the plurality of filaments 61, and the gaps between fibers are narrowed by the external force. Thereby, the resin particles 66 brought into contact with the surfaces of different filaments 61 are bonded together.

Afterward, the external force is relieved and the gaps between fibers are again enlarged, and thus the bonded resin particles 66 are separated from each other. As a result, the resin fibers **66*a* are formed from the resin particles 66 brought into contact with the filaments 61 of the band 164, and the fiber composite 67 is formed. The resin fibers 66*a* are also formed by passing the band 164 through the nip point N6 of the nip rolls N7, N8. The fiber composite 67 is wound on the predetermined winding roll 30. The wound fiber composite 67 is cut to predetermined dimensions, and thus the fiber article 65** is obtained.

As described above, in the production method for the fiber article 65 of the present embodiment, in the first processing step, the plurality of filaments 61 are inserted between the pair of nip rolls N4, N5 and pressed by the pair of nip rolls N4, N5, thereby applying the external force to the filaments 61 to which the resin particles 66 are brought into contact. Such a method can also efficiently produce the fiber article 65. Also, according to the present embodiment, the fiber article 65 using the filaments 61 that are not crimped is obtained. Therefore, design flexibility of the fiber article 65 can be improved. Note that when the nip rolls N4, N5 and the nip rolls N7, N8 are used as in the present embodiment, for example, the nip rolls N7, N8 may be omitted.

Confirmation Test

A confirmation test was performed to confirm the numerical range of the external force that enables the resin fibers **66*a* to be formed in the first processing step. In the band production apparatus 1 of the first embodiment, the pressure (nip pressure) of the pair of nip rolls N1, N2 was changed in a range of 0.05 MPa or greater to 0.06 MPa or less. Additionally, in the fiber article production apparatus 20, the pressure (nip pressure) of each of the pair of first filament opening rolls 26 and the pair of second filament opening rolls 27 was changed in a range of 0.10 MPa or greater to 0.41 MPa or less. Accordingly, the setting conditions of Examples 1 to 7 were prepared. In addition, Comparative Example 1 was prepared in which the pressure (nip pressure) of any of the pair of nip rolls N1, N2, the pair of first filament opening rolls 26, and the pair of second filament opening rolls 27** was set to 0 MPa. The results are indicated in Table 1.

TABLE 1

| | Pressure from nip rolls (MPa) | Pressure from first filament opening rolls (MPa) | Pressure from second filament opening rolls (MPa) | Resin fiber formation availability |
|---|---|---|---|---|
| Example 1 | 0.05 | 0.41 | 0.20 | Formable |
| Example 2 | 0.05 | 0.10 | 0.10 | Formable |
| Example 3 | 0.05 | 0.10 | 0.41 | Formable |
| Example 4 | 0.05 | 0.20 | 0.10 | Formable |
| Example 5 | 0.05 | — | — | Formable |
| Example 6 | 0.04 | — | — | Formable |
| Example 7 | 0.06 | — | — | Formable |
| Comparative Example 1 | — | — | — | Not formable |

*In Table, [—] indicates that no such rolls are used.

As indicated in Table 1, it was confirmed that the resin fibers **66*a* in Comparative Example 1 could not be formed, while it was confirmed that the resin fibers 66***a* in Examples 1 to 7 could be formed. Additionally, when the fiber article 65 of each of the Examples 1 to 7 was magnified and observed, it was confirmed that the fiber articles 65 of Examples 5 to 7 are formed such that the resin fibers 66*a* are abundantly distributed in a wide range compared to the fiber articles 65 of Examples 1 to 4. As a result, it is believed that at the time of producing the fiber article 65, the fiber article 65 including the resin fibers 66*a* abundantly formed and distributed in a wide range can be easily produced, for example, by performing the first processing step at a plurality of timings.

Note that each of the configurations, combinations thereof, or the like in each of the embodiments are examples, and additions, omissions, replacements, and other changes to the configurations may be made as appropriate without departing from the spirit of the present disclosure. The present disclosure is not limited by the embodiments and is limited only by the claims. Also, the aspects disclosed in the present specification can be combined with any other feature disclosed herein.

In the first embodiment, packaging the band 64 produced by the band production apparatus 1, 101 into the packaging container 19 is described. However, the fiber article 65 may be produced by introducing the band 64 into the fiber article production apparatus 20 without packaging the band 64. Further, the configuration of the fiber article production apparatus 20 is not limited to that described above. Furthermore, a slurry containing a relatively large amount of the resin particles 66 may be used as the dispersion used in the contact step. Additionally, the resin particles 66 may be brought into contact with the filaments 61 prior to forming the yarn 62 or the end 63.

INDUSTRIAL APPLICABILITY

As described above, according to the present disclosure, in the case of producing a fiber article formed by combining different types of fibers having different outer diameters, it is highly advantageous that a bulky fiber article having high functionality can be effectively produced. Therefore, it is useful to apply the disclosure widely to methods for producing fiber articles, which can exert such a significant advantage.

REFERENCE SIGNS LIST

N1, N2, N4, N5, N7 N8 Pair of nip rolls
P Transfer direction
61 Filament (first fiber)
64, 164 Band
65 Fiber article
66 Resin particle
66*a* Resin fiber (second fiber)
67 Fiber composite

The invention claimed is:

1. A production method for a fiber article, comprising:

a contact step of, while transferring a plurality of first fibers that are continuously spun, bringing a plurality of resin particles formed of polymers that can be fiberized into contact with the plurality of first fibers, the plurality of resin particles including lamellar structures;

a first processing step of applying an external force to the plurality of first fibers brought into contact with the plurality of resin particles and continuously spun, and narrowing gaps between fibers; and a second processing step of, by relieving the external force applied to the plurality of first fibers brought into contact with the plurality of resin particles, forming second fibers from the plurality of resin particles, the second fibers each having an outer diameter that is smaller than each of the first fibers and is set to a value in a range of 30 nm or greater to 1.0 μm or less, so that a fiber composite including the first fibers and the second fibers is formed.

2. The production method for a fiber article according to claim 1, wherein, in the first processing step, a band is formed by applying the external force to the first fibers to which the plurality of resin particles is added and crimping the first fibers.

3. The production method for a fiber article according to claim 2, wherein, in the first processing step, while transferring the band, tensile force is applied as the external force in a transfer direction to the plurality of first fibers brought into contact with the plurality of resin particles in the band.

4. The production method for a fiber article according to claim 1, wherein, in the first processing step, the plurality of first fibers is inserted between a pair of nip rolls and pressed by the pair of nip rolls, whereby the external force is applied to the first fibers brought into contact with the plurality of resin particles.

5. The production method for a fiber article according to claim 1, wherein, in the contact step, a dispersion in which the plurality of resin particles are dispersed is used.

6. The production method for a fiber article according to claim 5, further comprising a drying step of, between the contact step and the first processing step, drying at least a portion of the dispersion applied to the first fibers.

7. The production method for a fiber article according to claim 5, wherein an aqueous dispersion obtained by dispersing the plurality of resin particles in water is used as the dispersion.

8. The production method for a fiber article according to claim 5, wherein, in the contact step, the dispersion separated from the first fibers in the first processing step is reused.

9. The production method for a fiber article according to claim 1, wherein, in the contact step, the plurality of resin particles in a powder form are directly brought into contact with the first fibers.

10. The production method for a fiber article according to claim 1, wherein, in the first processing step, nip pressure set to a value of 0.05 MPa or greater is applied as the external force to the plurality of first fibers brought into contact with the plurality of resin particles.

11. The production method for a fiber article according to claim 1, wherein, in the second processing step, the fiber composite is formed so that a weight ratio W1/W2 of a total weight W1 of the first fibers to a total weight W2 of the second fibers and resin particles adhered to the first fibers is within a range of 3.00 or greater to 200.00 or less.

12. The production method for a fiber article according to claim 1, wherein, in the second processing step, a length dimension of the first fibers forms the fiber composite that is longer than a length dimension of the second fibers.

13. The production method for a fiber article according to claim 1, wherein, in the contact step, the first fibers each having an outer diameter set to a value in a range of 5 μm or greater and 50 μm or less are used.

14. The production method for a fiber article according to claim 1, wherein, in the contact step, the first fibers formed of at least one of rayon, polypropylene, polyethylene terephthalate, polyethylene, or cellulose acetate are used.

15. The production method for a fiber article according to claim 1, wherein, in the contact step, the resin particles formed of at least one of polytetrafluoroethylene, polypropylene, polyethylene, or polyamide are used.

* * * * *